US008297727B2

(12) United States Patent
Katayama

(10) Patent No.: US 8,297,727 B2
(45) Date of Patent: Oct. 30, 2012

(54) RECORDING APPARATUS AND RECORDING METHOD USING THE SAME, WITH AN EXTENDED STOP POSITION OF THE RECORDING UNIT

(75) Inventor: Hiroshi Katayama, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 406 days.

(21) Appl. No.: 12/623,309

(22) Filed: Nov. 20, 2009

(65) Prior Publication Data

US 2010/0129129 A1 May 27, 2010

(30) Foreign Application Priority Data

Nov. 25, 2008 (JP) ..... 2008-299438

(51) Int. Cl.
*B41J 29/38* (2006.01)

(52) U.S. Cl. ..... 347/5; 347/9; 347/16

(58) Field of Classification Search ..... 400/323, 400/292, 582; 347/5, 9, 16
See application file for complete search history.

(56) References Cited

U.S. PATENT DOCUMENTS 5,997,130 A * 12/1999 Bolash et al. ..... 347/37
7,314,260 B2 * 1/2008 Mizude et al. ..... 347/9
7,347,636 B2 * 3/2008 Jung ..... 400/303

FOREIGN PATENT DOCUMENTS

JP 2001-001592 A 1/2001
JP 2001-232882 A 8/2001
JP 2003-063085 A 3/2003

* cited by examiner

*Primary Examiner* — Judy Nguyen
*Assistant Examiner* — Justin Olamit
(74) *Attorney, Agent, or Firm* — Kilpatrick Townsend & Stockton LLP

(57) ABSTRACT

A recording apparatus includes a transport unit that transports a recording medium, a recording unit that performs recording on the recording medium based on record data, a moving unit that moves the recording unit in a direction intersecting a transport direction of the recording medium, a control unit that controls the recording unit, the transport unit and the moving unit, a stop position obtaining unit that calculates a present stop position, which reaches a present recording end position during present deceleration of the recording unit and which reaches a next recording start position during next acceleration of the recording unit, based on present and next record data, a determining unit that determines whether a standby time of the recording unit in a stop state occurs until a transport position.

7 Claims, 10 Drawing Sheets

FIG. 4A
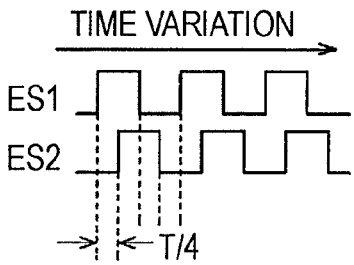
FIG. 4B
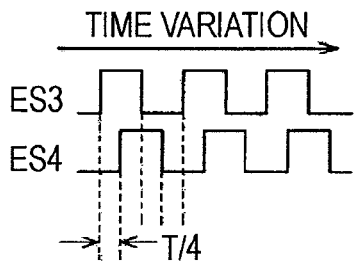
FIG. 5
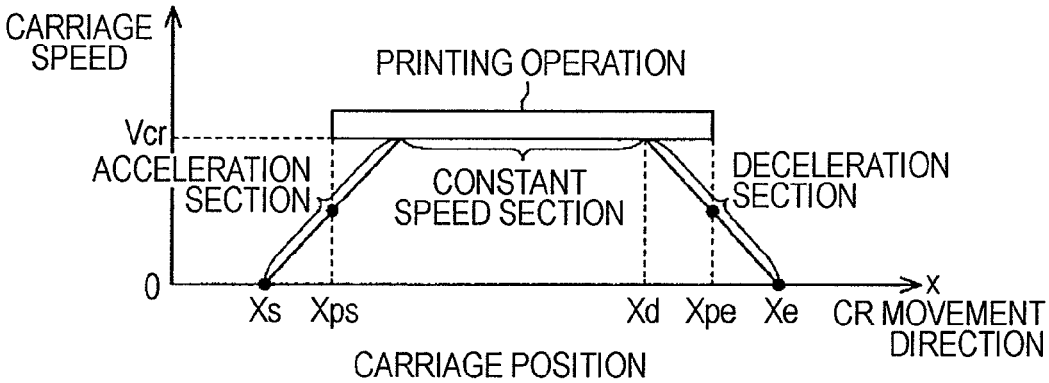
FIG. 6
| x | x11 x12··· x1n |
|---|---|
| t | t11 t12··· t1n |
CR ACCELERATION TABLE Dcr$\alpha$
| x | x21 x22···x2n |
|---|---|
| t | t21 t22··· t2n |
CR DECELERATION TABLE Dcr$\beta$

RECORDING APPARATUS AND RECORDING METHOD USING THE SAME, WITH AN EXTENDED STOP POSITION OF THE RECORDING UNIT

CROSS-REFERENCES TO RELATED APPLICATIONS

Priority is claimed under 35 U.S.C. §119 to Japanese Application No. 2008-299438 filed on Nov. 25, 2008 which is hereby incorporated by reference in its entirety.

BACKGROUND

1. Technical Field

The present invention relates to a recording apparatus in which a recording unit moving with a speed having an acceleration region and a constant speed region starts recording in the process of acceleration, and a recording method using the same.

2. Related Art

For example, JP-A-2003-063085 discloses a printing control apparatus of a serial type printing apparatus, which is provided with an acceleration/deceleration printing mode that starts a printing operation in the middle of an acceleration region before a carriage reaches a constant speed region. Further, JP-A-2003-063085, JP-A-2001-232882 and JP-A-2001-001592 disclose a technology of the serial type printing apparatus in which the carriage is driven in the process of deceleration of a paper feeding operation to start a printing operation (ink ejection) simultaneously with completion of the paper feeding operation, and the paper feeding operation starts simultaneously with completion of the printing operation in the process of movement before the carriage stops. As described above, the carriage movement operation and the paper feeding operation partially overlap during the start and completion of the carriage movement and the paper feeding operation, so that a printing process time is shortened.

However, even when a time required when next carriage driving is sufficiently accelerated and completed is ensured due to a long paper feeding time, accelerated printing is performed only with the increase of a carriage stop time, so a wasteful carriage stoppage time may occur. According to the accelerated printing, a printing operation starts at an early point in time in the process of acceleration of the carriage, so that printing throughput is improved. However, when the paper feeding time is increased, although there is a sufficient time for the carriage to move up to a position capable of ensuring a CR driving distance (run-up distance), at which the start of the printing operation is possible, after reaching the constant speed region, the carriage stops at a stop position corresponding to the run-up distance for performing the accelerated printing. Thus, improvement of the printing throughput may be limited.

SUMMARY

An advantage of some aspects of the invention is to provide a recording apparatus capable of achieving significant improvement of recording throughput in a configuration of performing accelerated printing, and a recording method using the same.

According to one aspect of the invention, there is provided a recording apparatus including a transport unit that transports a recording medium; a recording unit that performs recording on the recording medium based on record data; a moving unit that moves the recording unit in a direction intersecting a transport direction of the recording medium; a control unit that controls the recording unit, the transport unit and the moving unit; a stop position obtaining unit that calculates a present stop position, which reaches a present recording end position during present deceleration of the recording unit and which reaches a next recording start position during next acceleration of the recording unit, based on present and next record data; a determining unit that determines whether a standby time of the recording unit in a stop state occurs until a transport position of the transport unit, which transports the recording medium on which present recording has been completed to a next recording position, reaches a start position at which movement of the recording unit starts; and an extension processing unit that extends the present stop position in the range until the standby time lapses when the standby time occurs. When the stop position is extended by the extension processing unit, the control unit controls the moving unit and the recording unit such that the recording unit is stopped at the present stop position after the extension, thereby allowing the recording unit having started the next movement to reach the next recording start position at a higher speed side and to start a recording operation.

According to the invention, the determining unit determines whether a standby time of the recording unit in a stop state occurs until a transport position of the transport unit, which transports the recording medium on which present recording has been completed to a next recording position, reaches a start position at which the movement of the recording unit starts. Further, when the standby time occurs, the extension processing unit extends the present stop position, which is obtained by the stop position obtaining unit, in the range until the standby time lapses. Thus, when the extension of the stop position has been performed by the extension processing unit, since the present stop position of the recording unit is extended, the next movement of the recording unit starts from the extended stop position, so that the next recording start position is shifted to a higher speed side. For example, the recording unit can start a recording operation from a constant speed region after passing through an acceleration region. Thus, as compared with a case in which the extension of the stop position is not performed by the extension processing unit, the time necessary for recording of one row can be shortened, so that the recording apparatus can perform recording at a higher speed.

In the recording apparatus of the invention, preferably, the stop position obtaining unit includes: a calculating unit that calculates the present stop position, which reaches the present recording end position during the deceleration of the recording unit, based on the present record data; and a stop position change unit that calculates the present stop position, which reaches the next recording start position during the acceleration of the recording unit, based on the next record data during the movement of the recording unit for the present recording, and changes the present stop position calculated by the calculating unit into a relevant present stop position when it is determined that the relevant present stop position is located at a front side in the movement direction of the recording unit, as compared with the stop position calculated by the calculating unit.

According to the invention, the calculating unit calculates the present stop position, which reaches the present recording end position during the deceleration of the recording unit, based on the present record data. Then, during the movement of the recording unit for the present recording, the stop position change unit calculates the present stop position, which reaches the next recording start position during the acceleration of the recording unit, based on the next record data.

Further, when it is determined that the present stop position calculated by the stop position change unit is located at a front side in a movement direction of the recording unit as compared with the stop position calculated by the calculating unit, the stop position change unit changes the present stop position calculated by the calculating unit into the present stop position calculated by the stop position change unit. Thus, if the next movement of the recording unit starts from the present stop position, the recording unit can reach the recording start position in the process of the next acceleration. Further, even if the next record data is not prepared before the present movement of the recording unit starts, the next record data can be obtained during the present movement of the recording unit, so that the present stop position can be changed and extended.

Further, in the recording apparatus of the invention, the control unit is configured to transport the recording medium to the next recording position by driving the transport unit substantially simultaneously with completion of a recording operation of the recording unit, and to start the movement of the recording unit during execution of a transport operation of the recording medium such that next recording starts substantially simultaneously with stop of the transport operation of the recording medium. The control unit includes a transport time calculating unit that calculates a medium transport time corresponding to a time required for the transport unit to transport the recording medium to the next recording position, and an interval time calculating unit that calculates a recording interval time from a time point at which a present recording operation of the recording unit is completed to a time point at which a next recording operation of the recording unit starts. Preferably, the determining unit determines whether the medium transport time exceeds the recording interval time, and the extension processing unit extends the present stop position of the recording unit in a range in which the medium transport time is not smaller than the recording interval time when the medium transport time exceeds the recording interval time.

According to the invention, the movement of the recording unit starts in the process of the transport operation such that the next transport operation of the recording medium is performed substantially simultaneously with the completion of the recording operation of the recording unit, and the next recording starts substantially simultaneously with the stop of the transport operation of the recording medium, so that accelerated/decelerated recording can be performed. Further, the determining unit determines whether the medium transport time calculated by the time calculating unit exceeds the recording interval time calculated by the interval time calculating unit. When the medium transport time exceeds the recording interval time, the extension processing unit extends the present stop position of the recording unit in a range in which the medium transport time is not smaller than the recording interval time. Thus, whether the present stop position can be extended can be relatively determined in a relatively simple manner by comparing the medium transport time with the recording interval time.

Further, in the recording apparatus of the invention, preferably, the processing by the stop position changing unit, the determining unit and the extension processing unit is performed during the present movement of the recording unit.

According to the invention, since the processing by the stop position changing unit, the determining unit and the extension processing unit is performed during the present movement of the recording unit, even if the next record data can be obtained only after the present movement of the recording unit starts, the extension process is performed with respect to the present stop position, so that the next recording start position can be shifted to the higher speed side.

In the recording apparatus of the invention, preferably, the extension processing unit performs the extension process of extending the present stop position by a predetermined amount, and repeats the extension process by the predetermined amount when the determining unit determines that the recording interval time based on the present stop position according to a result of the extension process does not exceed the medium transport time, thereby fixing the extended present stop position.

According to the invention, the extension processing unit extends the present stop position by the predetermined amount, and repeats the extension process by the predetermined amount when the determining unit determines that the recording interval time does not exceed the medium transport time, thereby fixing the extended present stop position. Thus, as long as the recording interval time does not exceed the medium transport time, the recording start position can be shifted to the higher speed side as much as possible. For example, the recording start position can be extended to the higher speed side in the acceleration region.

Further, in the recording apparatus of the invention, preferably, the recording unit moves with a speed profile having an acceleration region, a constant speed region and a deceleration region, the extension processing unit performs the extension process of extending the present stop position by the predetermined amount, and the determining unit determines whether a movement speed of the recording unit, which has reached the next recording start position, has reached the constant speed region based on the present stop position after the extension process. When it is determined that the movement speed of the recording unit has reached the constant speed region, the extension processing unit completes the extension process although the recording interval time based on the present stop position after the extension process does not exceed the medium transport time.

According to the invention, the determining unit determines whether the movement speed of the recording unit, which has reached the next recording start position, has reached the constant speed region based on the present stop position after the extension process. When it is determined that the movement speed of the recording unit has reached the constant speed region, the extension processing unit completes the extension process of the predetermined amount although the recording interval time based on the present stop position after the extension process does not exceed the medium transport time. Thus, when the recording start position reaches the constant speed region, since the recording start position cannot be further shifted to a higher speed side although the present stop position is extended, additional wasteful extension and determination processes or the like can be omitted.

Further, in the recording apparatus of the invention, preferably, the determining unit determines if extension of the present stop position is possible until the next recording start position of the recording unit reaches the constant speed region, and, if it is determined that the extension of the present stop position is possible until the next recording start position of the recording unit reaches the constant speed region, the present stop position is extended until the next recording start position reaches the constant speed region.

According to the invention, only when it is determined by the determining unit that the extension of the present stop position is possible until the next recording start position of the recording unit reaches the constant speed region, the present stop position is extended until the next recording start position reaches the constant speed region. Thus, only when the present stop position is sufficiently extended and the recording start position can reach the constant speed region faster, the present stop position is extended, so that the number of processes of the extension processing unit and the determining unit can be reduced (e.g., one time).

Further, according to another aspect of the invention, there is provided a recording method, which uses a recording apparatus provided with a transport unit that transports a recording medium, a recording unit that performs recording on the recording medium, a moving unit that moves the recording unit in a direction intersecting a transport direction of the recording medium by using the transport unit, and a control unit that controls the recording unit, the transport unit and the moving unit, including: calculating a present stop position, which reaches a present recording end position during present deceleration of the recording unit and which reaches a next recording start position during next acceleration of the recording unit, based on present and next record data; determining whether a standby time of the recording unit in a stop state occurs until a transport position, through which the recording medium on which present recording has been completed is transported to a next recording position by the transport unit, reaches a start position at which movement of the recording unit starts; extending the present stop position in the range until the standby time lapses when the standby time occurs; and, when the stop position is extended by the extension processing unit, controlling by the control unit the moving unit and the recording unit such that the recording unit is stopped at the present stop position after the extension, thereby allowing the recording unit having started the next movement to reach the next recording start position at a higher speed and to start a recording operation. According to the recording method, the same effects as those in the recording apparatus can be obtained.

BRIEF DESCRIPTION OF THE DRAWINGS

The invention will be described with reference to the accompanying drawings, wherein like numbers reference like elements.

FIGS. 4A and 4B are views showing waveforms of pulses of each encoder.

FIG. 5 is a graph showing a speed profile of a CR motor.

FIG. 6 is a view showing a CR acceleration table and a CR deceleration table.

DESCRIPTION OF EXEMPLARY EMBODIMENTS

First Embodiment

Figure 1:
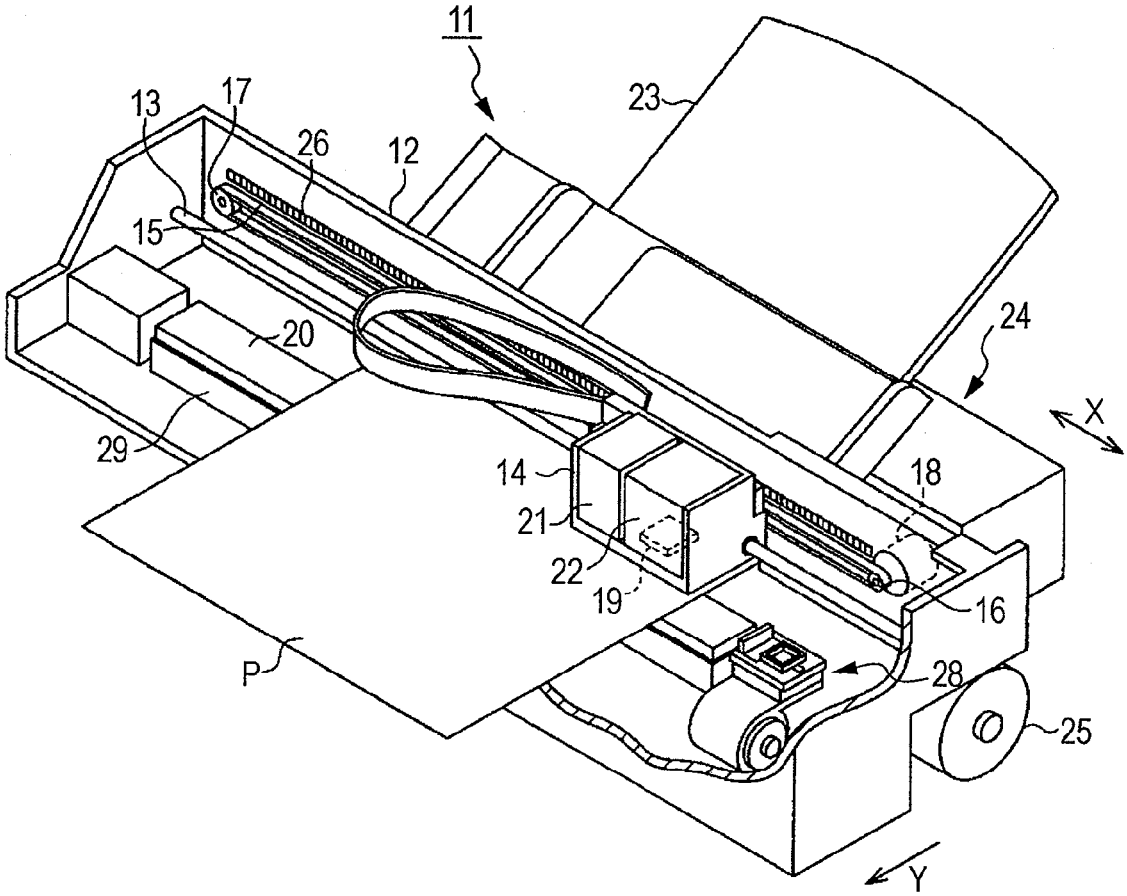
FIG. 1 is a perspective view schematically showing a printer according to a first embodiment.

Hereinafter, an ink jet recording apparatus according to a first embodiment of the invention will be described in detail with reference to FIGS. 1 to 13. FIG. 1 is a perspective view showing the ink jet recording apparatus having no exterior case. As shown in FIG. 1, the ink jet recording apparatus (hereinafter, referred to as a printer 11) as a recording apparatus includes a body case 12 having a substantially rectangular box shape with an upper opening. A guide shaft 13 is installed in the body case 12 and a carriage 14 is installed in the guide shaft 13 such that the carriage 14 is guided in a main scanning direction (direction X shown in FIG. 1) to reciprocate. An endless timing belt 15 fixed to a rear surface of the carriage 14 is wound around a pair of pulleys 16 and 17 installed on an inner surface of a rear plate of the body case 12, and a carriage motor (hereinafter, referred to as a CR motor 18) having a driving shaft connected to the pulley 16 rotates in forward and backward directions, so that the carriage 14 reciprocates in the main scanning direction X.

A recording head 19 (recording unit) is installed at a lower portion of the carriage 14 to eject ink, and a platen 20 is installed at a downstream side facing the recording head 19 in the body case 12 in such a manner that the platen 20 extends in the direction X to define an interval between the recording head 19 and a paper P serving as a recording medium. Further, a black ink cartridge 21 and a color ink cartridge 22 are provided on the carriage 14 such that they are detachably coupled to the carriage 14. The recording head 19 ejects the ink of each color, which is supplied from the ink cartridges 21 and 22, through nozzles for each color.

The printer 11 is provided on the rear surface thereof with a sheet feeding tray 23, and an auto sheet feeder 24 that supplies only one uppermost sheet of a plurality of papers P stacked on the sheet feeding tray 23 to a downstream side in a sub-scanning direction Y.

Further, a paper feeding motor (hereinafter, referred to as a PF motor 25) provided at a lower portion of a right side of the body case 12 in FIG. 1 is driven so that a transport roller 31 (paper feeding roller) and a paper discharge roller 32 (see FIG. 2) are rotated, so that the paper P is transported in the sub-scanning direction Y. Further, while the carriage 14 is reciprocating in the main scanning direction X, a printing operation, in which the ink is ejected toward the paper P from the nozzles of the recording head 19, and a paper feeding operation, in which the paper P is transported in the sub-scanning direction Y by a predetermined transport amount, are alternately repeated (herein, timings of the operations partially overlap), so that characters, images or the like are printed on the paper P.

In addition, a linear encoder 26 is installed in the printer 11 such that the linear encoder 26 extends along the guide shaft 13 to output pulses proportional to a movement distance of the carriage 14, and speed and position control of the carriage 14 is performed based on movement position, direction and speed of the carriage 14 calculated using the output pulses of the linear encoder 26. A maintenance apparatus 28 that performs a cleaning operation for preventing and solving clogging of the nozzles of the recording head 19 is provided directly below the carriage 14 when the carriage 14 is located at a home position (one end portion other than a printing region on a carriage movement path, see a right end portion of FIG. 1) in the printer 11. Further, a waste liquid tank 29 is installed under the platen 20 such that ink absorbed by the maintenance apparatus 28 from the nozzles of the recording head 19 is discarded.

Figure 2:
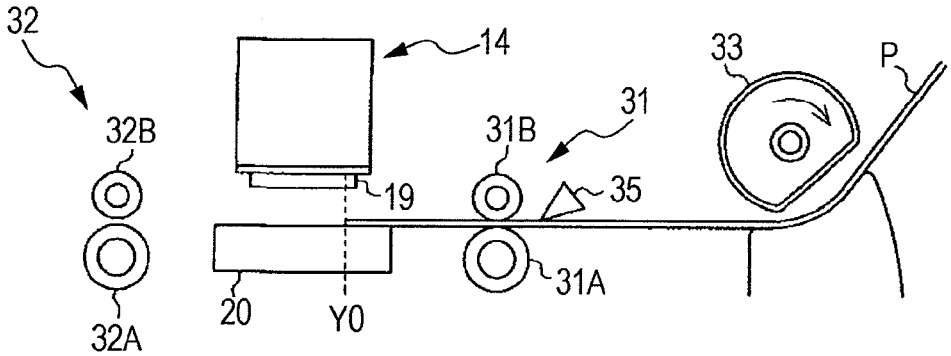
FIG. 2 is a side view schematically showing a recording head and a transport mechanism.

FIG. 2 is a side view schematically showing the recording head and the transport mechanism. As shown in FIG. 2, the transport roller 31 and the paper discharge roller 32, which constitute a transport unit, are sequentially and rotatably installed on the transport path of the paper P while interposing a recording position (i.e., a platen 20) of the recording head 19 therebetween in the transport direction of the paper P. The transport roller 31 includes a pair of a driving roller 31A and a driven roller 31B, and the paper discharge roller 32 includes a pair of a driving roller 32A and a driven roller 32B. The two driving rollers 31A and 32A are rotated by driving force applied from the PF motor 25 (see FIG. 1), so that the paper P is transported in the left direction (the sub-scanning direction Y) of FIG. 2. That is, a paper feeding roller 33 installed at an upstream side of the transport roller 31 in the paper transport direction is rotated by power applied from the PF motor 25 through a clutch unit (not shown), so that the paper P is fed.

A paper detection sensor 35 is installed at a position in a slight upstream side of the transport roller 31 in the transport direction. The paper detection sensor 35, for example, is prepared in the form of a contact type sensor (switch type sensor), and is turned on by displacing a detection lever when the front end of the supplied paper P comes into contact with the detection lever while being turned off when the detection lever has returned to an original standby position by spring force after the rear end of the paper P passes through the detection lever. That is, it is preferred that the paper detection sensor 35 can detect ends of the paper P. In addition, the paper detection sensor 35 may employ a non-contact type sensor such as an optical sensor.

As shown in FIG. 2, according to the embodiment, the position (see FIG. 2) of the paper P having reached to the position corresponding to a nozzle position (uppermost nozzle position) at the uppermost side in the transport direction of the recording head 19 is set as an origin used for managing a position of the paper P in the transport direction. After the front end of the paper P is detected by the paper detection sensor 35, when the paper P is transported by a predetermined amount and the front end thereof reaches the origin position corresponding to the uppermost nozzle position, a PF counter 84 (see FIG. 3), which will be described later, is reset. The PF counter 84 can count a count value corresponding to a length from the front end of the paper to the origin, and detect the position of the paper P in the transport direction from the counted value.

Figure 3:
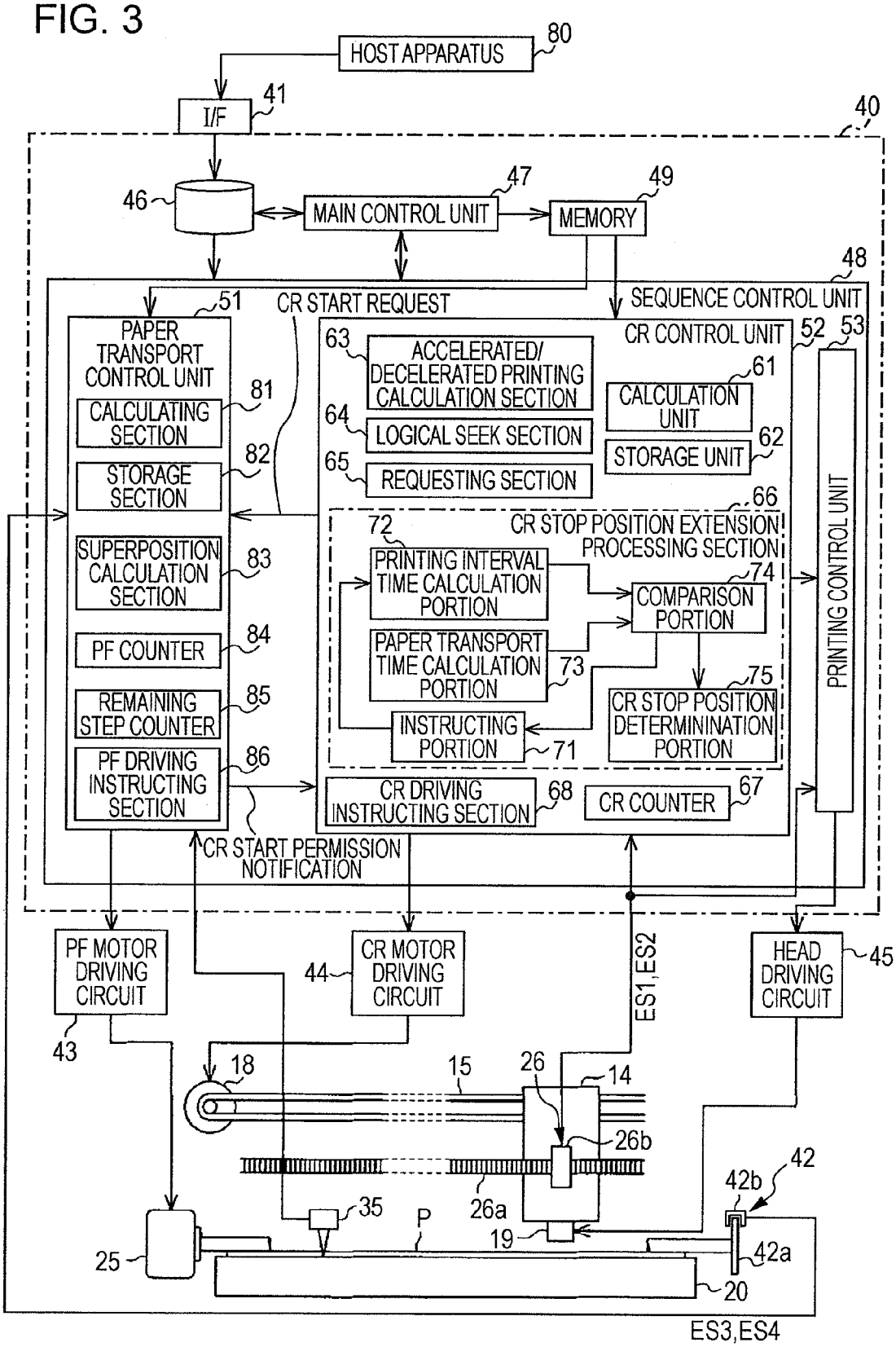
FIG. 3 is a block diagram showing an electrical configuration of a printer.

FIG. 3 is a diagram schematically showing the electrical configuration of the printer 11. The printer 11 includes a controller 40, an interface (hereinafter, referred to as an I/F 41), the CR motor 18, the PF motor 25, the linear encoder 26, the paper detection sensor 35, a rotary encoder 42, a PF motor driving circuit 43, a CR motor driving circuit 44, a head driving circuit 45 or the like.

The controller 40 receives print data from a host apparatus 80 (for example, a personal computer or the like) through the I/F 41. The controller 40 includes a buffer 46, a main control unit 47 and a sequence control unit 48. The main control unit 47 interprets commands of the print data received from the host apparatus 80 through the I/F 41 and transmits various requests including a paper feeding request and a printing request to the sequence control unit 48 according to instructions of the commands. The main control unit 47 transmits raster data (bit map data), except for the commands, of the print data to the sequence control unit 48 (in detail, a printing control unit 53).

The sequence control unit 48 outputs instruction values to the PF motor driving circuit 43, the CR motor driving circuit 44 and the head driving circuit 45 according to a predetermined sequence based on the requests from the main control unit 47 such that a paper supply operation, a printing operation, a paper feeding operation and a paper discharge operation. The sequence control unit 48 includes a paper feeding control unit 51 that controls the driving of the PF motor 25 through the PF motor driving circuit 43, a CR control unit 52 that controls the driving of the CR motor 18 through the CR motor driving circuit 44, and a printing control unit 53 that controls the driving of the recording head 19 through the head driving circuit 45.

The paper feeding control unit 51 sets a start and running schedule (driving schedule) of the PF motor 25 and controls the driving of the PF motor 25 through the PF motor driving circuit 43 to perform paper supply, paper feeding and paper discharge of the paper P.

Further, the CR control unit 52 sets a start and running schedule (driving schedule) of the CR motor 18, and controls the driving of the CR motor 18 through the CR motor driving circuit 44 during printing to move the carriage 14 in the main scanning direction X.

The paper feeding control unit 51 and the CR control unit 52 perform motor driving control including partial superposition control (PF and CR superposition control) with respect to the operation timings of the paper feeding operation and the carriage operation. According to the PF and CR superposition control, the start timing of the CR motor 18 is controlled such that the printing operation (ink ejection) starts simultaneously with the completion of the paper feeding operation, and the start timing of the PF motor 25 is controlled such that the paper feeding operation starts simultaneously with the completion of the printing operation (ink ejection). In detail, the paper feeding control unit 51 having received a CR start request from the CR control unit 52 calculates a paper feeding position corresponding to the CR start timing, and then transmits CR start permission notification to the CR control unit 52 when the paper feeding position is reached, so that the control for the start timing of the CR motor 18 is performed. Further, the CR control unit 52 transmits PF start permission notification to the paper feeding control unit 51 at the time point at which the carriage 14 reaches a printing end position, so that the control for the start timing of the PF motor 25 is performed.

The printing control unit 53 sets a printing schedule to control the driving of the recording head 19. Further, the printing control unit 53 performs various operation processes, which are necessary for determining an ejection time or the like, at which ink droplets are ejected (fired) from the recording head 19, and a process for determining a printing area (printing operation area in FIG. 5) on which the ink droplets are allowed to be ejected.

The linear encoder 26 includes a tape-shaped sign plate 26*a* in which a plurality of slits are formed every a constant pitch (e.g., 1/180 inch (=2.54/180 cm)), and a sensor 26*b* provided with a light emitting device and a light receiving device installed in the carriage 14. The light receiving device received light transmitting the slits after being emitted from the light emitting device when the carriage 14 moves, so that the sensor 26*b* outputs two linear encoder pulses ES1 and ES2 (pulse signals) with phases A and B having a phase difference of 90° therebetween as shown in FIG. 4A.

The rotary encoder 42, as shown in FIG. 3, includes a disk-shaped sign plate 42*a* fixed to an end of a shaft (e.g., a shaft of the driving roller 31A) power-transmittingly connected with the PF motor 25, and a sensor 42*b* that receives light transmitting slits of the sign plate 42*a* to output two encoder pulses ES3 and ES4 (pulse signals) with phases having a phase difference of 90° therebetween as shown in FIG. 4B.

The main control unit 47 calculates a printing start position (ink ejection start position) serving as a recording start position, and a printing end position (ink ejection end position) based on print data (record data) corresponding to one row (1 path), and stores the printing start position and the printing end position in a memory 49. If the printing process preparation of the present row is ended, the main control unit 47 notifies the paper feeding control unit 51 and the CR control unit 52 of paper feeding and carriage driving requests, respectively.

If the paper feeding request is received, the paper feeding control unit 51 performs a paper feeding sequence. If the carriage driving request is received, the CR control unit 52 performs a carriage operation sequence. The paper feeding control unit 51 and the CR control unit 52 are configured to access the memory 49 to obtain information necessary for performing the sequences from the memory 49.

After the carriage operation sequence starts, the CR control unit 52 first transmits the CR start request including information such as next printing start and end positions to the paper feeding control unit 51. The CR control unit 52 includes a calculation section 61, a storage section 62, an accelerated/decelerated printing calculation section 63 (calculation unit), a logical seek section 64 (stop position changing unit), a requesting section 65, a CR stop position extension processing section 66 (extension processing unit), a CR counter 67 and a CR driving instruction section 68. Further, the paper feeding control unit 51 includes a calculation section 81, a storage section 82, a supposition calculation section 83, a PF counter 84, a remaining step counter 85 and a PF driving instruction section 86.

The CR control unit 52 obtains data related to printing start position and printing end position from the memory 49. Further, the accelerated/decelerated printing calculation section 63 calculates start and end positions of the carriage 14 by using the printing start position and the printing end position. FIG. 5 is a graph showing a speed profile of the carriage 14. In the graph, a transverse axis denotes a carriage position x and a longitudinal axis denotes a carriage speed V. The CR speed profile according to the embodiment includes an acceleration region in which the carriage 14 is accelerated until the carriage 14 reaches a constant speed Vcr starting from the CR start position Xs, a constant speed region in which the constant speed Vcr is maintained, and a deceleration region in which the carriage 14 is decelerated from the constant speed Vcr until the carriage 14 reaches the CR stop position Xe. The embodiment employs accelerated/decelerated printing in which printing (ink ejection) starts in the middle of the acceleration region of the carriage 14 and continues in the middle of the deceleration region. In detail, as shown in FIG. 5, the printing start position Xps is set in the middle of the acceleration region of the carriage 14 and the printing end position Xpe is set in the middle of the deceleration region of the carriage 14.

The accelerated/decelerated printing calculation section 63 calculates the CR start position Xs and the CR stop position Xe when the accelerated/decelerated printing is performed. Herein, the accelerated/decelerated printing denotes printing control that starts the printing operation from the printing start position Xps set in the middle of the acceleration region and ends the printing operation at the printing end position Xpe set in the middle of the deceleration region as shown in FIG. 5. According to the embodiment, the accelerated/decelerated printing is basically performed. However, in relation to a path (printing row) satisfying a condition which will be described later, the carriage speed (CR speed) when the printing starts, which has been set in the middle of the acceleration region, is controlled to be shifted to a higher speed side from the initial value of the accelerated/decelerated printing.

Figure 7A:
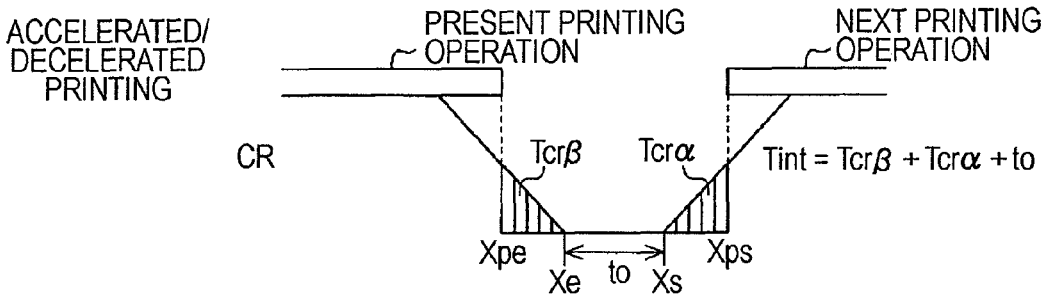
FIGS. 7A to 7C are graphs showing a CR stop position extension process.

The logical seek section 64 obtains a next printing start position Xps based on next print data (print data of next row) during movement of the carriage 14. Further, in a case in which the carriage 14 stops at the present CR stop position Xe calculated by the accelerated/decelerated printing calculation section 63, in relation to the next carriage operation at which the present CR stop position Xe is employed as the CR start position, the logical seek section 64 determines whether a run-up distance (run-up driving amount of the PF motor 25) which is enough to reach the minimum speed necessary for accelerated printing until the carriage 14 reaches the next printing start position Xps, is ensured. When it is determined that the run-up distance is not ensured, the logical seek section 64 extends the CR stop position Xe up to the positional which the run-up distance can be ensured. Thus, after the carriage 14 is stopped at the CR stop position Xe, a wasteful operation, in which the carriage 14 is moved up to the position at which the accelerated/decelerated printing can be performed at the next path, is unnecessary, and the accelerated/decelerated printing performed by starting the carriage 14 from the CR stop position Xe as shown in FIG. 7A can be performed every path.

That is, the CR control unit 52 determines whether the linear encoder pulse ES2 is in a high or low state when detecting a rising edge of the linear encoder pulse ES1 input from the linear encoder 26 after the carriage driving is performed, thereby detecting a carriage movement direction. The CR counter 67 counts the number of edges of the linear encoder pulses ES1 and ES2 with two phases as shown in FIG. 4A which are input from the linear encoder 26. Then, the CR counter 67 increments the counted value in the movement direction (forward movement) in which the carriage 14 is away from a home position, and decrements the counted value in the movement direction (backward movement) in which the carriage 14 approaches the home position, so that the carriage position is managed by employing the home position as an origin. In detail, the CR counter 67 includes a first counter that counts the position of the carriage 14 in the main scanning direction in which the home position is employed as the origin, and a second counter that counts the carriage position (CR position) at which the CR start position is employed as the origin in the process of the movement of the carriage 14.

Further, the PF counter 84 counts the number of edges of the encoder pulses ES3 and ES4 with two phases as shown in FIG. 4B which are input from the encoder 42. In detail, the PF counter 84 includes a first counter that counts the position of a paper in the transport direction, and a second counter that counts a paper feeding position at which a paper feeding start position is employed as the origin in the process of the paper feeding.

In the CR counter 67 and the PF counter 84, the first counters are used for detecting the carriage position and the paper position while the second counters are used for detecting relative positions until a one-time operation employing a starting point thereof as an origin is ended, and the counted values are used for controlling the speeds of the CR motor 18 and the PF motor 25. That is, the counted values of the second counters are used for motor control. However, the following description will be given by using the CR counter 67 and the PF counter 84 without particularly distinguishing the first counter from the second counter.

FIG. 6 is a view showing an acceleration/deceleration table used for controlling the speed of the CR motor. The storage unit 62 as shown in FIG. 3 stores the acceleration/deceleration table as shown in FIG. 6. The acceleration/deceleration table includes a CR acceleration table Dcrα used in the acceleration region and a CR deceleration table Dcrβ used in the deceleration region. The CR acceleration table Dcrα includes table data which represents a relationship between the carriage position x, which is counted by the CR counter 67 (the second counter) after the CR start position Xs is employed as the origin, and the period t of the linear encoder pulses ES1 and ES2. Further, the CR deceleration table Dcrβ includes table data which represents a relationship between the carriage position x, which is counted by the PF counter 84 after the deceleration start position Xd is employed as the origin, and the period t of the linear encoder pulses ES1 and ES2. The period t is a value proportional to a reciprocal number of the carriage speed V, and the CR driving instruction section 68 outputs a current instruction value corresponding to the period t to the CR motor driving circuit 44 to perform speed control with respect to the CR motor 18.

Figure 7B:
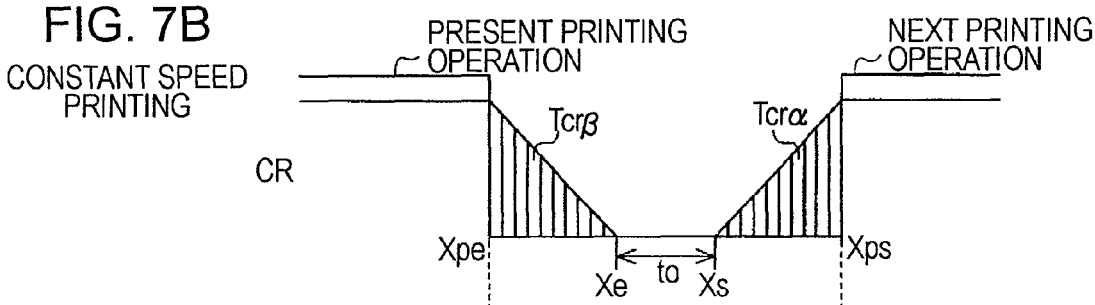
Figure 7C:
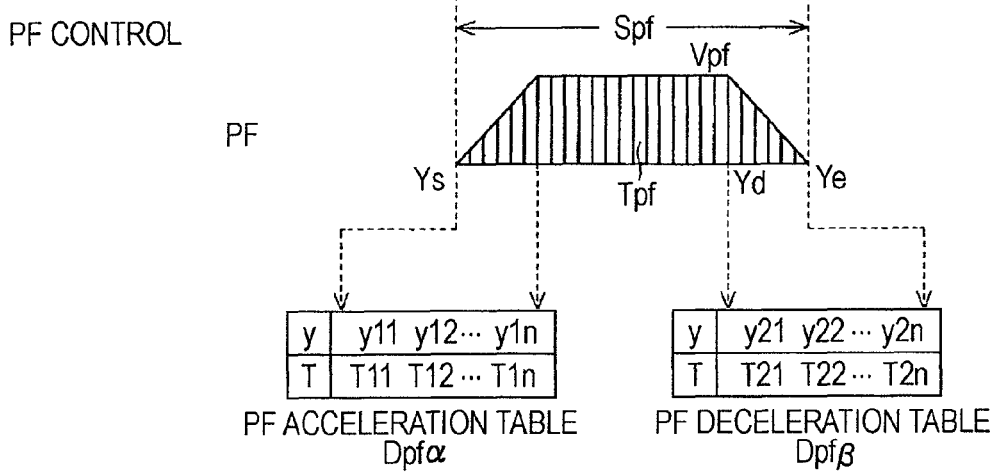

FIGS. 7A to 7C are graphs showing a CR speed profile and a PF speed profile. In detail, FIG. 7A is a graph showing the CR speed profile when the accelerated/decelerated printing is performed and FIG. 7B is a graph showing the CR speed profile when the constant speed printing is performed. Further, FIG. 7C is a graph showing the PF speed profile.

Referring to the accelerated/decelerated printing as shown in FIG. 7A, when the paper feeding time Tpf is longer than the printing interval time Tint, the CR stop position Xe as shown in FIG. 7A is extended in the progress direction (carriage movement direction) of the printing operation, so that the CR stop position Xe is maximally extended in the range of reaching the constant speed region as shown in FIG. 7B within the range in which the printing interval time Tint is shorter than the paper feeding time Tpf. According to the extension processing for the CR stop position Xe, the CR stop position Xe is extended by one step of the CR position, the printing interval time Tint and the paper feeding time Tpf are calculated whenever the extension corresponding to one step is performed, and the CR stop position extension process is repeated as long as the condition of (Tpf>Tint) is satisfied. However, the CR stop position extension process is set not to be performed when the printing start position Xps reaches the constant speed region in the next CR operation as a result of extending the CR stop position Xe.

The CR stop position extension processing section 66 includes an instruction portion 71, a printing interval time calculation portion 72 (interval time calculating unit), a paper feeding time calculation portion 73 (feeding time calculating unit), a comparing portion 74 and a CR stop position determining portion 75.

The instruction portion 71 provides the printing interval time calculation portion 72 with data of the CR stop position Xe (initial value) calculated by the logical seek section 64 such that the CR stop position extension process is performed. Then, the printing interval time calculation portion 72 calculates the printing interval time Tint, which is an interval time (empty time for which the printing operation is not performed) between the present printing operation and the next printing operation, by using the data of the present CR stop position Xe provided from the instruction portion 71. In other words, the printing interval time Tint corresponds to an elapsed time until the carriage 14 reaches the next printing start position Xps after reaching the present printing end position Xpe.

The paper feeding time calculation portion 73 calculates the paper feeding time Tpf which is a necessary time of a paper feeding operation starting after the present printing operation is completed. As shown in FIG. 7C, the speed profile of the paper feeding operation, for example, is a trapezoidal waveform with an acceleration region, a constant speed region and a deceleration region. The storage section 82 of the paper feeding control unit 51 stores various pieces of PF speed data in which target speeds (a constant speed of the constant speed region) are different from each other. According to the PF speed data, as the target speed is high, transport distances (transport amount) of the acceleration region and the deceleration region are set to be long. The calculation section 81 selects one target speed (constant speed), which is the highest speed, from the PF speed data satisfying a condition in which provided paper feeding amount is greater than a sum of the distances of the acceleration region and the deceleration region.

Further, in relation to the storage section 82, the acceleration/deceleration table used for controlling the speed of the PF motor 25 is stored in each PF speed data. The acceleration/deceleration table, as shown in FIG. 7C, includes a PF acceleration table Dpfα and a PF deceleration table Dpfβ. The PF acceleration table Dpfα includes table data which represents a relationship between the paper position y, which is counted by the PF counter 84 after the PF start position Ys is employed as the origin, and the period T of the encoder pulses ES3 and ES4. Further, the PF deceleration table Dpfβ includes table data which represents a relationship between the paper position y, which is counted by the PF counter 84 after the deceleration start position Yd is employed as the origin, and the period T of the encoder pulses ES3 and ES4. The period T is a value proportional to a reciprocal number of the paper feeding speed, and the PF driving instruction section 86 outputs a current instruction value corresponding to the period T to the PF motor driving circuit 43 to perform speed control with respect to the PF motor 25.

If the paper feeding control unit 51 determines the acceleration/deceleration table used for next paper feeding, the CR control unit 52 obtains information on the paper feeding amount and the acceleration/deceleration table from the paper feeding control unit 51. Then, the paper feeding time calculation portion 73 calculates the paper feeding time Tpf necessary for the next paper feeding operation by using the obtained information. The paper feeding time Tpf is obtained by summing an acceleration time Tpfα which is a necessary time of the acceleration region, a constant speed time Tpfc which is a necessary time of the constant speed region, and a deceleration time Tpfβ which is a necessary time of the deceleration region.

In detail, the paper feeding time calculation portion 73 integrates periods T11 to T1*n* corresponding to all paper positions y11 to y1*n* belonging to the acceleration region with reference to the PF acceleration table Dpfα as shown in FIG. 7C, thereby calculating the acceleration time Tpfα. Further, the paper feeding time calculation portion 73 integrates periods T21 to T2*n* corresponding to all paper positions y21 to y2*n* belonging to the deceleration region with reference to the PF deceleration table Dpfβ as shown in FIG. 7C, thereby calculating the acceleration time Tpfβ. Further, the paper feeding time calculation portion 73 calculates a transport distance at the constant speed region by subtracting a transport distance advancing at the acceleration region and a transport distance advancing at the deceleration region from the paper feeding amount Spf, and obtains the constant speed time Tpfc (=transport distance of the constant speed region (counted value of the counter)×constant speed period To) by integrating a constant speed period To (period corresponding to the constant speed) with respect to all paper positions y at the constant speed region. Then, the paper feeding time calculation portion 73 calculates the paper feeding time Tpf (=Tpfα+Tpfβ+Tpfc) by adding the acceleration time Tpfα, the deceleration time Tpfβ and the constant speed time Tpfc. That is, the constant speed time Tpfc (Spfc/Vpf), which is the paper feeding time at the constant speed region, is obtained by dividing the paper feeding amount Spfc (=Spf−Sα−Sβ) at the constant speed region, which is obtained by subtracting the paper feeding amount Sα at the acceleration region and the paper feeding amount Sβ at the deceleration region from the present paper feeding amount Spf, by a constant speed Vpf.

The comparing portion 74 compares the printing interval time Tint calculated by the printing interval time calculation portion 72 with the paper feeding time Tpf calculated by the paper feeding time calculation portion 73, and outputs an on signal and an off signal to the instruction portion 71 and the CR stop position determining portion 75, respectively, when the condition of (Tpf>Tint) is satisfied. As a result of the comparison performed by the comparing portion 74, when the condition of (Tpf>Tint) is not satisfied, the comparing portion 74 outputs an off signal and an on signal to the instruction portion 71 and the CR stop position determining portion 75, respectively.

If the on signal is received from the comparing portion 74, the instruction portion 71 extends the CR stop position Xe by one step (Xe=Xe+1), and provides the printing interval time calculation portion 72 with the CR stop position Xe extended by one step. The printing interval time calculation portion 72 calculates the printing interval time Tint based on the CR stop position Xe extended by one step, and outputs the calculated printing interval time Tint and the paper feeding time Tpf to the comparing portion 74. Then, the comparing portion 74 compares whether the condition of (Tpf>Tint) is satisfied. Until the condition of (Tpf>Tint) is satisfied as a result of the comparison performed by the comparing portion 74 and the on signal is input to the CR stop position determining portion 75 from the comparing portion 74, the instruction portion 71 extends the CR stop position Xe by one step (Xe=Xe+1).

If the on signal is received from the comparing portion 74, the CR stop position determining portion 75 obtains data of the CR stop position Xe at that time from the instruction portion 71, and determines the obtained CR stop position as the present CR stop position Xe. Further, the printing start position Xps obtained through the calculation process of the printing interval time calculation portion 72 is sent to the CR stop position determining portion 75 whenever the CR stop position Xe is extended by one step. Then, the CR stop position determining portion 75 determines whether the printing start position Xps has reached the constant speed region. When it is determined that the printing start position Xps has reached the constant speed region, the CR stop position determining portion 75 obtains a current CR stop position Xe from the instruction portion 71 to determine the CR stop position Xe as the present CR stop position Xe, and instructs stop of the CR stop position extension processing.

Figure 8:
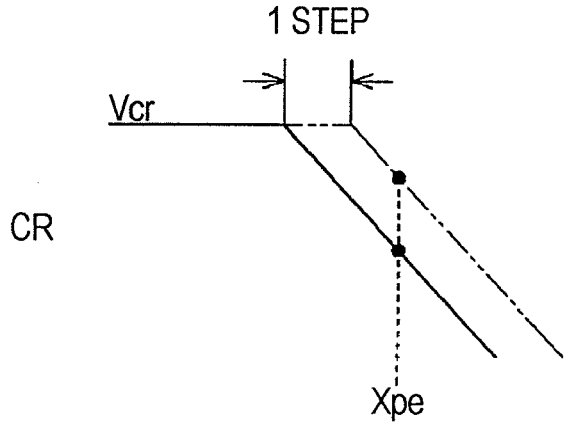
FIG. 8 is a graph showing a CR stop position extension process.

FIG. 8 is a graph showing the extension processing performed by the CR stop position extension processing section 66. If the instruction portion 71 extends the CR stop position Xe by one step, as shown in FIG. 8, the deceleration start position is extended by one step, so that the printing end position Xpe at the deceleration region is shifted to a higher speed side by one step. Whenever the CR stop position Xe is extended by one step as described above, the printing end position Xpe is shifted to the higher speed side by one step and the run-up distance (distance from the CR start position to the printing start position Xps) of the next path is increased by one step (see FIG. 7), so that the printing start position Xps of the next path is shifted to the higher speed side by one step.

Referring again to FIG. 3, if the CR start request is received from the CR control unit 52 during the paper feeding operation, the paper feeding control unit 51 performs PF and CR supposition calculation, and transmits CR driving permission notification to the CR control unit 52 if the paper P reaches a carriage start permission position (hereinafter, referred to as a CR start permission position Ycr) which is obtained through the above calculation. If the CR driving permission notification is received, the CR control unit 52 drives the CR motor 18 to start the carriage 14.

Figure 9:
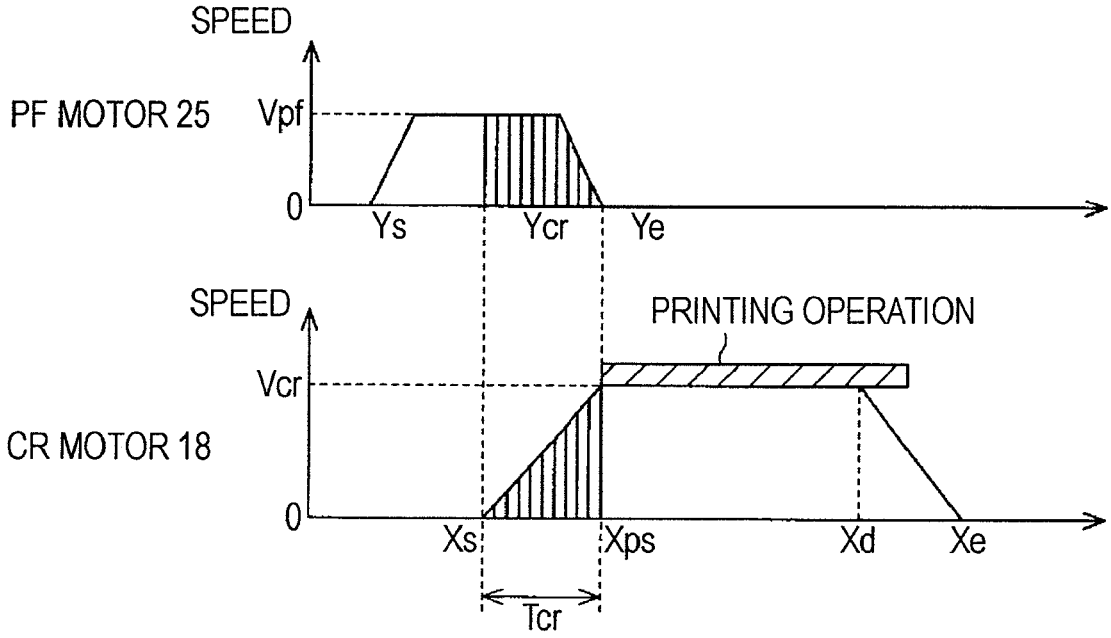
FIG. 9 is a graph showing a superposition operation of a PF motor and a CR motor.

Hereinafter, the PF and CR superposition calculation method by which the supposition calculation section 83 calculates the CR start permission position Ycr will be described. FIG. 9 is a graph schematically showing the speed profile (PF speed profile) of the PF motor 25 and the speed profile (CR speed profile) of the CR motor 18. In FIG. 9, the upper PF speed profile shows an example in which the printing start position Xps is a position when reaching the constant speed region. In relation to the CR start permission position Ycr, the start timing of the carriage 14, at which the carriage 14 can reach the printing start position Xps at the paper feeding operation end time point (PF position Ye), is expressed by the PF position (the number of remaining steps). Thus, after a necessary time (hereinafter, referred to as a CR movement time Tcr) until the carriage 14 reaches the printing start position Xps from the CR start position Xs is calculated, the PF position, which is obtained by allowing the target stop position Ye of the paper feeding operation to be withdrawn by the CR movement time Tcr, becomes the CR start permission position Ycr. According to the embodiment, the CR movement time Tcr calculated by the calculation section 61 of the CR control unit 52 is output to paper feeding control unit 51 together with the CR start request.

Hereinafter, the calculation method of the CR movement time Tcr will be described. The calculation section 61 reads the next printing start position Xps from the memory 49, obtains the current position (next CR start position Xs) of the carriage 14 in a stop state from the CR counter 67, and calculates the distance Lc from the next CR start position Xs to the next printing start position Xps. Then, the calculation section 61 obtains the CR movement time Tcr (=t11+t12+ . . . +t1*n*, see FIG. 9) by adding the period t from the CR start position Xs (x11) to the printing start position Xps (e.g., x1*n* corresponding to the distance Lc) by one step (corresponding to ¼ encoder pulse) with reference to the CR acceleration table Dcrα of FIG. 6. In addition, the next CR movement time Tcr, which is an estimated time obtained through calculation, may be corrected by using the CR movement time Ter actually timed in previous time.

Further, the supposition calculation section 83 calculates the CR start permission position Ycr by using the next CR movement time Tcr as described below. As shown in FIG. 9, the supposition calculation section 83 performs an addition process in which the period T obtained with reference to the PF deceleration table Dpfβ (see FIG. 7C) is added by one step (¼ encoder pulse) sequentially starting from the target stop position Ye in the PF speed profile. At this time, the addition process is repeated until the added value Tpfs (=T2*n*+T2*n*−1+ . . . ) exceeds the CR movement time Tcr, and the number Spfs of additions (i.e., the number of steps) is counted. The number Spfs of additions when the added value Tpfs (=T2*n*+T2*n*−1+ . . . ) exceeds the CR movement time Tcr for the first time is obtained as the paper feeding amount (i.e., the number Scrstart of the remaining steps of CR start) from the CR start permission position Ycr to the target stop position Ye. That is, when obtaining the number Scrstart of the remaining steps of the CR start, a transform coefficient G reflecting the difference of clock frequencies used for driving control of the CR motor 18 and the PF motor 25 is multiplied.

The remaining step counter 85 as shown in FIG. 3 includes a subtraction counter. Before the present paper feeding operation starts (the PF motor starts), the present paper feeding amount is set to the initial value Sto. After the paper feeding operation starts, the remaining step counter 85 decrements the counted value by 1 whenever the pulse edge is received from the encoder 42. Then, if the number St (counted value) of remaining steps reaches the number Scrstart of the remaining steps of the CR start, the paper feeding control unit 51 is configured to transmit the CR start permission notification to the CR control unit 52. That is, if the counted value is 0, the remaining step counter 85 determines that the paper P has been transported to the target stop position Ye. Further, according to the embodiment, the number St of remaining steps corresponds to the transport position, and the number Scrstart of the remaining steps of the CR start corresponds to the start position at which the movement of the recording unit is to be started.

The printing control unit 53 calculates the printing start position Xps and the printing end position Xpe based on the print data. If the counted value of the CR counter 67 reaches the printing start position Xps, the printing control unit 53 controls ejection of the recording head 19 through the head driving circuit 45 based on the print data, thereby causing the printing operation in which ink droplets are ejected from the nozzles of the recording head 19. In addition, if the counted value of the CR counter 67 reaches the printing end position Xpe, the printing operation is completed.

The main control unit 47 and the sequence control unit 48 constituting the controller 40 can be provided as software by of a CPU that executes a control program, or can be provided as hardware by an integrated circuit such as an ASIC. In addition, the main control unit 47 and the sequence control unit 48 can be constructed with the cooperation between software and hardware.

Hereinafter, the processing operation of the sequence control unit 48 will be described with reference to flowcharts of FIGS. 10 to 13. First, the CR stop position extension process will be described with reference to flowcharts of FIGS. 10 and 11. The CR stop position extension process is performed by the CR control unit 52.

In step S10, the present CR driving amount Dcr and the present CR stop position Xe are calculated. That is, the calculation section 61 reads the printing start position Xps and the printing end position Xpe which are calculated in advance by the main control unit 47 from the memory 49, and fixes the present CR speed profile such that the positions Xps and Xpe respectively match with the printing start position in the middle of the acceleration region and the printing end position in the middle of the deceleration region for accelerated/decelerated printing in the CR speed profile. Then, the calculation section 61 calculates the CR driving amount from the fixed present CR speed profile. In addition, the printing end position Xpe may be calculated by the calculation section 61.

In step S20, the printing operation starts. That is, the CR driving instruction section 68 instructs driving start of the CR motor 18. After the printing operation starts, the CR driving instruction section 68 orders a current instruction value in response to the period t corresponding to the carriage position x with reference to the CR acceleration/deceleration tables Dcrα and Dcrβ, thereby controlling the speed of the carriage 14 along the previously fixed CR speed profile. For example, print data of the next path is stored in the buffer 46 after the present printing operation starts.

In step S30, the CR start position Xs of the next path (next CR start position) is calculated. According to the example, after the printing operation starts, the main control unit 47 calculates the CR start position Xs of the next path based on the print data of the next path read from the buffer 46, and stores the calculated CR start position Xs of the next path in the memory 49.

In step S40, it is determined whether the next CR start position Xs is greater than the present CR stop position Xe (i.e., Xs>Xe). If the condition of (Xs>Xe) is satisfied, step S50 is performed to execute a logical seek process. That is, the logical seek section 64 performs the logical seek process, so that the present CR stop position Xe is extended to the next CR stop position Xs. Further, the Xs and Xe values are always increased proportionally to the position in the carriage movement direction although the movement direction of the carriage 14 has been changed.

In step S60, the paper feeding time Tpf is calculated. That is, since the paper feeding control unit 51 decides in advance the PF speed profile of the next paper feeding operation determined from the next paper feeding amount, the paper feeding time calculation portion 73 integrates all periods T in a paper feeding section with reference to the PF acceleration/deceleration tables Dpfα and Dpfβ according to the PF speed profile obtained from the paper feeding control unit 51, thereby calculating the paper feeding time Tpf (see FIG. 7C).

In step S70, the printing interval time Tint between the present printing end and the next printing start is calculated. That is, the printing interval time calculation portion 72 calculates the printing interval time Tint. In detail, as shown in FIG. 7A, the printing interval time calculation portion 72 calculates a deceleration time Tcrβ by integrating the period t at the section between the present printing end position Xpe and the CR stop position Xe with reference to the CR deceleration table Dcrβ. Further, the printing interval time calculation portion 72 calculates an acceleration time Tcrα by integrating the period t at the section between the next CR start position Xs and the printing start position Xps with reference to the CR acceleration table Dcrα. Then, the printing interval time calculation portion 72 calculates the printing interval time Tint by using an equation (Tint=Tcrβ+Tcrα+to). In the equation, the time to denotes a processing time necessary for preparation (reading and various setting of the table for speed control) of the next printing operation (CR driving).

Figure 11:
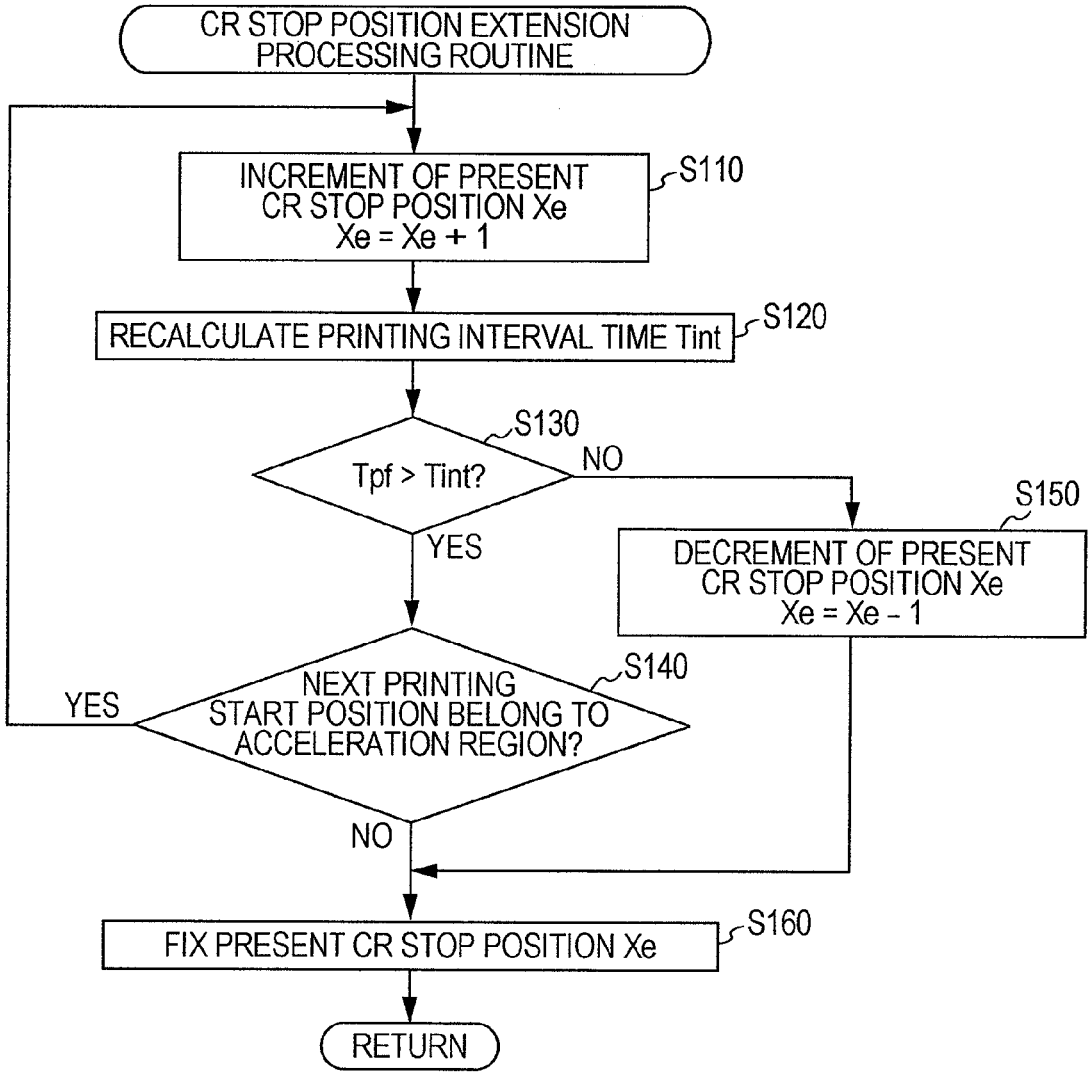
FIG. 11 is a flowchart showing a CR stop position extension process routine.

In step S80, it is determined whether the paper feeding time Tpf is longer than the present printing interval time Tint, that is, the condition of (Tpf>Tint) is satisfied. That is, it is determined whether there occurs an extra standby time until the carriage 14 starts next time after the carriage 14 stops this time. When the condition of (Tpf>Tint) is satisfied, the CR stop position extension process is performed to extend the CR stop position Xe of the this path. In contrast, when the condition of (Tpf>Tint) is not satisfied, the CR stop position Xe determined in step S10 or S50 is fixed, and the corresponding process is completed. The CR stop position extension process is performed when the CR stop position extension processing section 66 executes a CR stop position extension processing routine as shown in FIG. 11. That is, the CR stop position extension processing corresponds to the processing of the CR stop position extension processing section 66 after the condition of (Tpf>Tint) is satisfied (positive determination in S80) as a result of the first comparison performed by the comparing portion 74, and the on signal is input to the instruction portion 71.

According to the CR stop position extension process, first, in step S110, the present CR stop position Xe is incremented (Xe=Xe+1).

In the next step S120, the printing interval time Tint is recalculated. That is, the printing interval time calculation portion 72 calculates the printing interval time Tint based on the CR stop position Xe extended by one step (see FIGS. 7A and 7B). In such a case, as shown in FIGS. 7A and 7B, the CR stop position Xe is extended by one step, so that the printing end position Xpe in the deceleration region of the present CR speed profile is shifted to a higher speed side by one step, and the deceleration time Tcrβ is increased by the period t corresponding to one step shifted. Further, the printing start position Xps in the acceleration region on the next CR speed profile is shifted to a higher speed side by one step, and the acceleration time Tcrα is increased by the period t corresponding to one step shifted.

In step S130, it is determined whether the paper feeding time Tpf is longer than the present printing interval time Tint (i.e., the condition of (Tpf>Tint) is satisfied. When the condition of (Tpf>Tint) is satisfied, step S140 is performed to determine whether the next printing start position Xps belongs to the acceleration region. If the next printing start position Xps belongs to the acceleration region, the procedure returns to step S110, so that the present CR stop position Xe is incremented and steps S120, S130 and S140 are performed in the same manner. Further, when the condition of (Tpf>Tint) is not satisfied as a result of repetition of steps S110 to S140, the present CR stop position Xe is decremented (Xe=Xe−1) in step S150 and the present CR stop position Xe is fixed (step S160). When the CR stop position extension processing section 66 has extended the CR stop position Xe, the CR control unit 52 sets an extension flag not shown.

On the other hand, in step S140 before the condition of (Tpf>Tint) is not satisfied, if the next printing start position Xps belongs to the constant speed region (negative determination in S140), the CR stop position Xe at that time is fixed as the present CR stop position Xe. The CR stop position extension process is performed as described above, so that the present CR stop position Xe is fixed.

Figure 10:
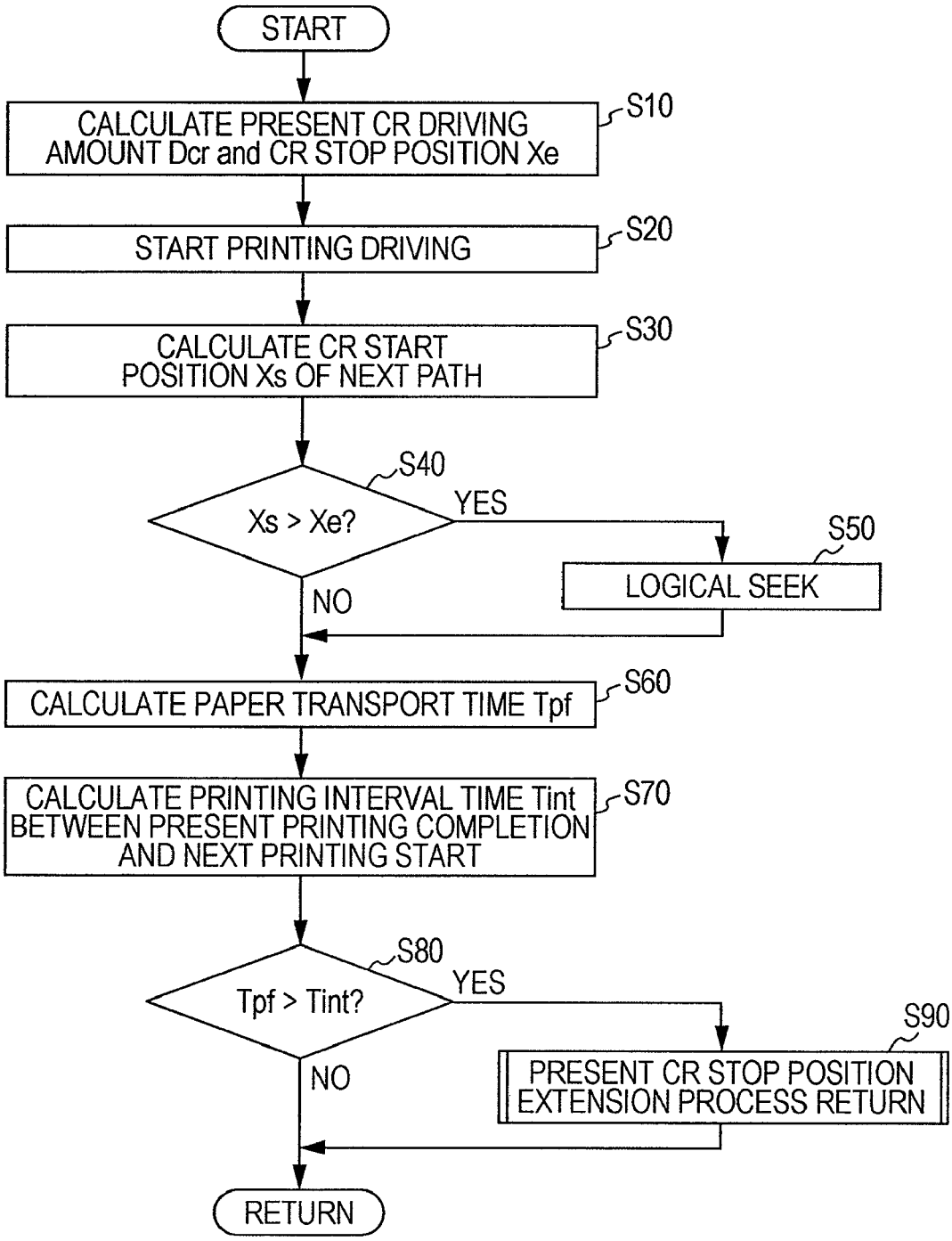
FIG. 10 is a flowchart showing a printing operation process.
Figure 12:
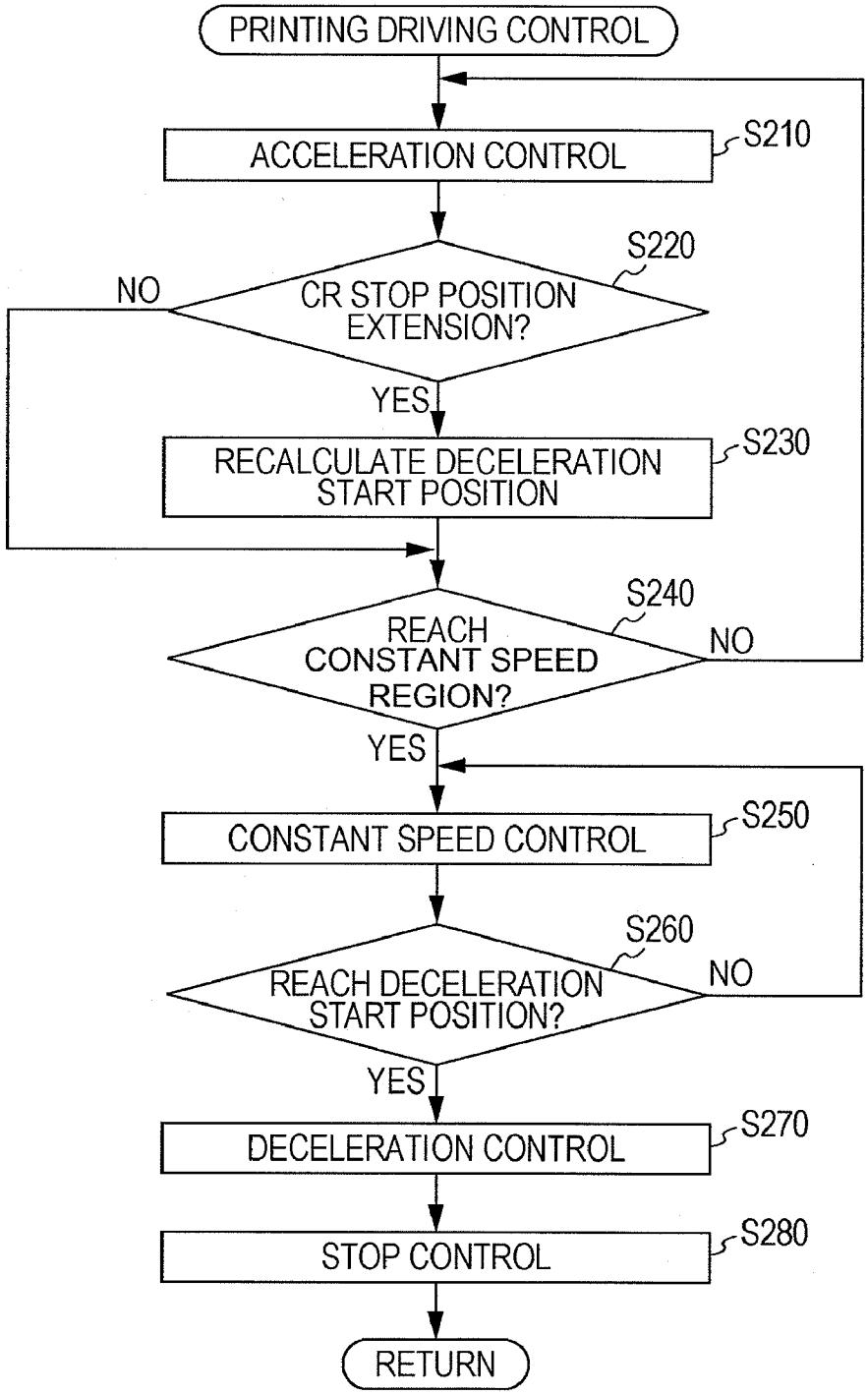
FIG. 12 is a flowchart showing a printing operation control routine.

Through the instruction for the printing operation start in step S20 of FIG. 10, the CR control unit 52 executes the printing operation control routine as shown in FIG. 12 to perform the CR driving control.

That is, if the CR motor 18 is driven, acceleration control is first performed (step S210) and the presence or absence of the CR stop position extension is determined (step S220). That is, if the extension flag has a value of 1, it is determined that the CR stop position extension is present. In contrast, if the extension flag has a value of 0, it is determined that the CR stop position extension is not present. In a case in which the CR stop position extension is present (i.e., the extension flag has a value of 1), the deceleration start position is recalculated (step S230). In detail, the calculation section 61 calculates the deceleration start position located at a position withdrawn from the extended CR stop position by the distance of the deceleration region. That is, both whether the CR stop position extension is present and the CR stop position Xe in the case of extending the CR stop position are determined in the process of acceleration of the carriage 14.

Further, the CR control unit 52 determines whether the position of the carriage 14 has reached the constant speed region based on the counted value of the CR counter 67 (step S240). S210 to S240 are repeated until the position of the carriage 14 reaches the constant speed region.

If the position of the carriage 14 reaches the constant speed region (positive determination in S240), constant speed control is performed (step S250). Then, after the constant speed control is continued until the carriage 14 reaches the deceleration start position, if it is determined that the carriage 14 has reached the deceleration start position (positive determination in step S260), deceleration control is performed with respect to the CR motor 18 (step S270). That is, the CR control unit 52 performs the deceleration control with reference to the CR deceleration tables Dcrβ by allowing the CR driving instruction section 68 to order an instruction value of the period t corresponding to the relative position x, in which the deceleration start position Xd is employed as the origin. Then, if the carriage 14 reaches the CR stop position, the CR control unit 52 performs stop control (step S280). As a result, the carriage 14, for example, is stopped at the present CR stop position Xe after the extension.

In the printing operation process, if the carriage 14 reaches the printing start position Xps, the printing control unit 53 drives the recording head 19 to start the printing operation in which ink droplets are ejected from the nozzles thereof. Then, if the carriage 14 reaches the printing end position Xpe, the printing operation is completed. For example, in a case in which the present printing start position Xps is extended within the acceleration region, the printing operation starts at a higher speed side as compared with normal accelerated/decelerated printing. Further, in a case in which the present printing start position Xps is extended until the present printing start position Xps belongs to the constant speed region, the constant speed printing is performed, in which the printing operation starts after the present printing start position Xps reaches the constant speed region as shown in FIGS. 7B and 7C.

Further, when it is determined that the carriage 14 has reached the printing end position Xpe based on the counted value of the CR counter 67 during the printing operation (CR driving), the CR control unit 52 performs paper feeding start permission notification with respect to the paper feeding control unit 51. As a result, the paper feeding operation starts simultaneously with the completion of the printing operation.

Figure 13:
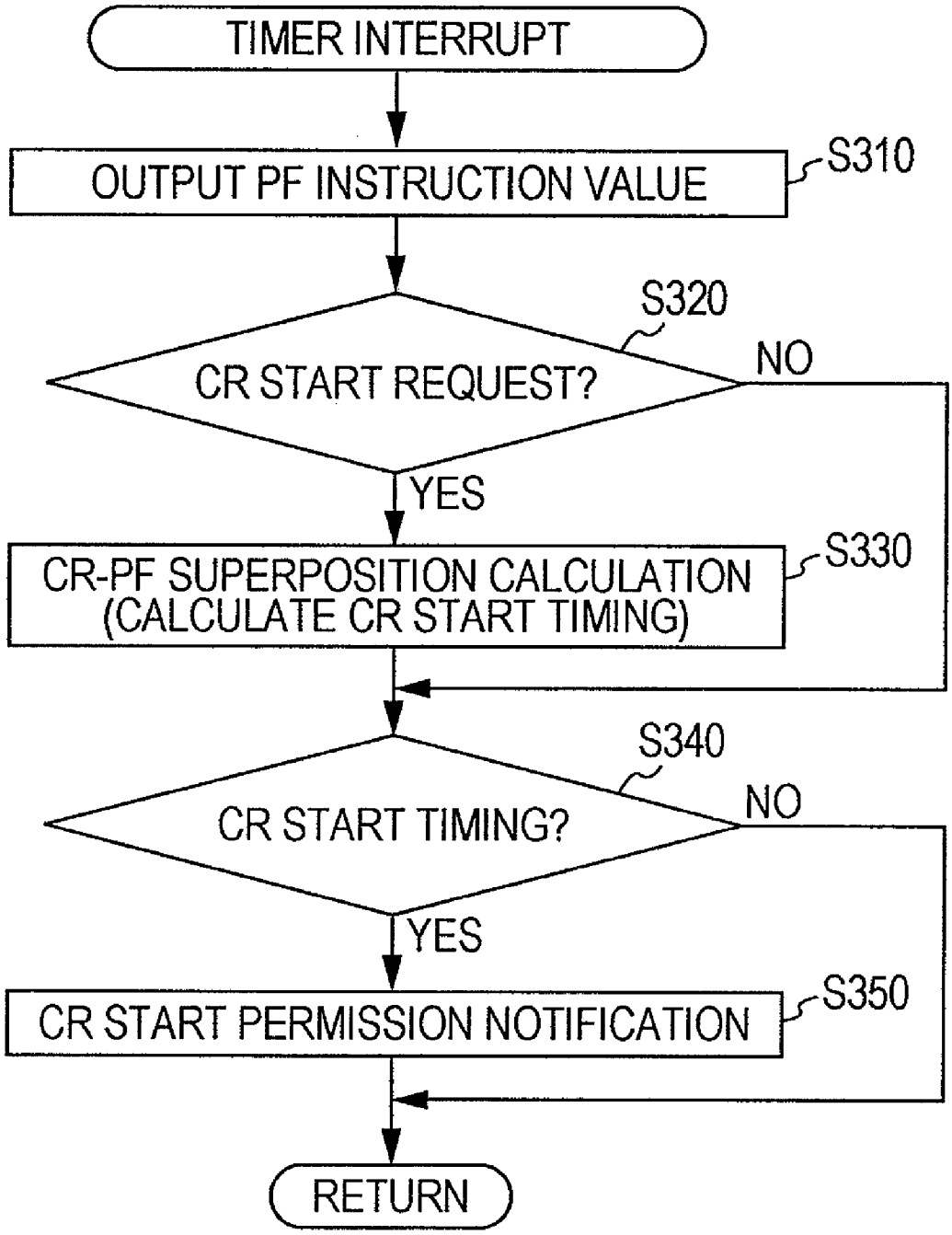
FIG. 13 is a flowchart showing a timer interruption process.

If the paper feeding start permission notification is received, the paper feeding control unit 51 executes the program as shown in FIG. 13 by timer interruption. The timer interruption is performed, so that the paper feeding operation and the CR and PF superposition control are performed.

In step S310, PF instruction value output is performed. That is, the calculation section 81 performs a feedback operation for paper feeding speed control (PID control operation in the embodiment), and performs paper feeding control by outputting the obtained PF instruction value to the PF motor driving circuit 43 from the PF driving instruction section 86. The PF instruction value is output every predetermined time interval by the timer interruption, so that the paper feeding operation is performed according to the PF speed profile.

In step S320, the presence or absence of the CR start request is determined. When it is determined that the CR start request is present, step S330 is performed. In contrast, when it is determined that the CR start request is not present, step S340 is performed.

In step S330, the CR and PF superposition operation (CR start timing calculation) is performed. That is, the superposition calculation section 83 calculates the CR start permission position Ycr (i.e., the number Scrstart of the remaining steps of the CR start). The operation is performed only one time when the CR start request is received.

In step S340, it is determined whether the CR start timing is reached. That is, it is determined that the CR start timing is reached when the counted value of the remaining step counter 85, which counts (subtracts) the number of remaining steps up to the target stop position Ye of the paper feeding, is equal to or less than the number Scrstart the remaining steps of the CR start. If the CR start timing is reached, the paper feeding control unit 51 performs the CR start permission notification with respect to the CR control unit 52 in step S350.

According to the embodiment as described above, the following effects can be obtained.

(1) if there is a margin in the next paper feeding time Tpf (the printing interval time Tint from the printing operation end time point to the next printing start time point is longer than the paper feeding time Tpf), that is, if the condition of (Tpf>Tint) is satisfied, the present CR stop position Xe is extended. Thus, the run-up distance until the next printing operation starts can be extended, so that the CR speed at the printing start position Xps can be shifted to a higher speed side, and the next printing operation can start at the higher CR speed as compared with the initial setting of the accelerated/decelerated printing. Accordingly, the time necessary for the next printing operation can be shortened. In addition, the next printing operation can be completed earlier, so that the next paper feeding operation can start early. Consequently, the printing throughput can be improved by the shortened time.

(2) if there is a margin in the next paper feeding time Tpf, the present CR stop position Xe is extended until the run-up distance, which is necessary for the next printing start position Xps to reach the constant speed region, can be ensured. In such a case, printing of the next path can be changed from the accelerated/decelerated printing to the constant speed printing. Thus, the printing operation can start at the higher CR speed, so that the printing throughput can be effectively improved.

(3) even when it is impossible to ensure the run-up distance which is required until the speed of the carriage reaches the constant speed for the next printing operation, since the printing start position is shifted to a higher speed side in the acceleration region in a range in which there is a margin in the next paper feeding time, the time necessary for the printing operation can be shortened, so that the printing throughput can be effectively improved as compared with the initial setting of the accelerated/decelerated printing.

(4) if the printing start position Xps reaches the constant speed region in the CR stop position extension process, although the condition of (Tpf>Tint) is satisfied, since an additional extension process is not performed, a wasteful process is discarded, so that the processing load of a CPU or the like can be reduced.

(5) since the CR stop position extension process is performed during the CR travel, the present printing operation (CR driving) can start without waiting for an operation result of the main control unit 47 after the next print data is stored in the buffer 46. For example, if the CR stop position extension process is performed before the CR travel starts, a wasteful standby time may occur until the next printing operation range is fixed. However, according to the embodiment, it is possible to avoid such a problem.

Second Embodiment

Figure 14:
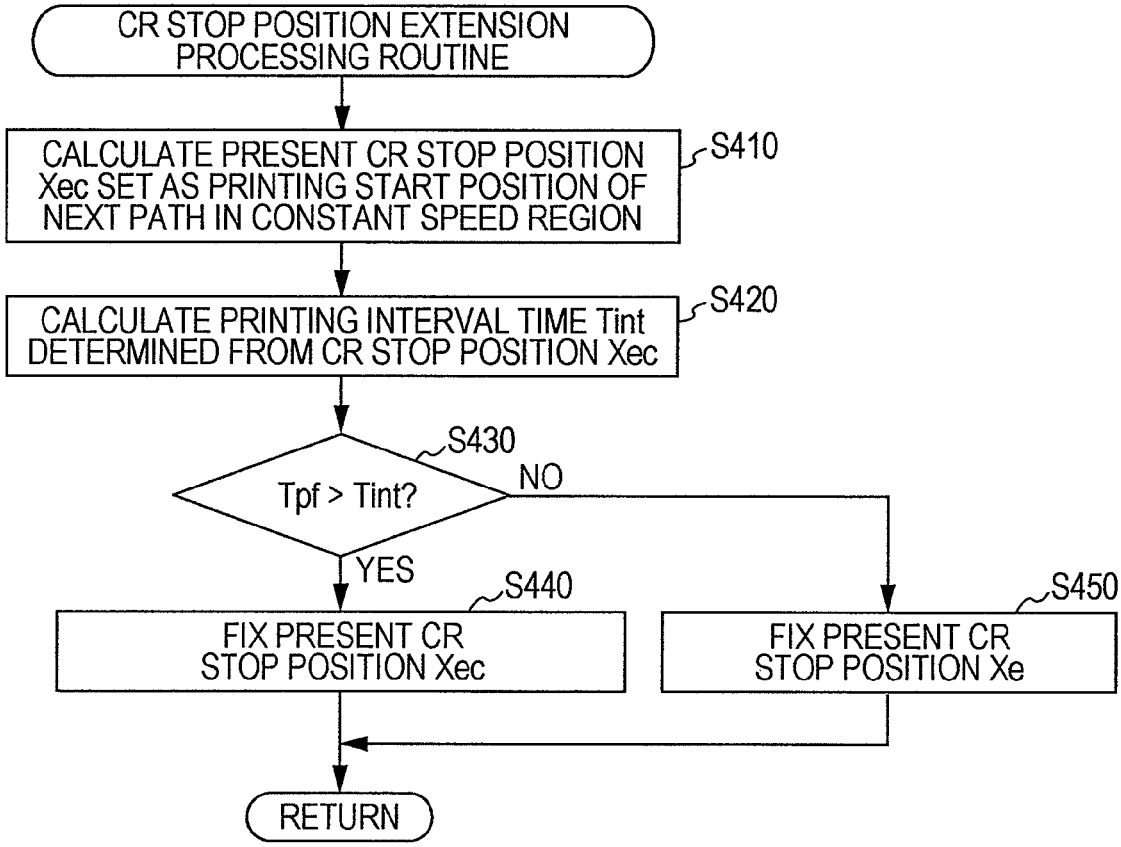
FIG. 14 is a flowchart showing a CR stop position extension process routine according to a second embodiment.

Hereinafter, the second embodiment will be described with reference to FIG. 14. According to the second embodiment, only when the run-up distance, which is necessary for starting the printing operation after the CR speed reaches the constant speed region, can be ensured, the CR stop position Xe is extended. FIG. 14 is a flowchart showing a CR stop position extension processing routine according to the embodiment. Since other processes are identical to those in the first embodiment, only the CR stop position extension processing routine will be described in the embodiment.

First, in step S410, the present CR stop position Xec, which can be set as a printing start position of the next path in the constant speed region, is calculated. That is, the present CR stop position Xec represents a CR stop position having a minimized extension distance from among CR stop positions which can be set as the printing start position of the next path in the constant speed region.

Next, in step S420, the printing interval time Tint determined from the present CR stop position Xec is calculated. In other words, the printing interval time Tint from the present printing end to the next printing start is calculated.

In step S430, it is determined whether the paper feeding time Tpf is longer than the present printing interval time Tint, that is, the condition of (Tpf>Tint) is satisfied. When the condition of (Tpf>Tint) is satisfied, step S440 is performed to fix an extended present CR stop position Xec. In contrast, when the condition of (Tpf>Tint) is not satisfied, step S450 is performed to fix the present CR stop position Xe before extension.

As a result, in a case in which the extended present CR stop position Xec is fixed, after the carriage 14 is stopped at the extended present CR stop position Xec, the next CR start is performed from the extended CR stop position Xec. Thus, the next printing operation starts after the CR speed reaches the constant speed region, so that the next printing operation is switched from the accelerated/decelerated printing to the constant speed printing. Consequently, in relation to the path for which the next printing operation is switched into the constant speed printing, the time necessary for the printing operation can be shortened, so that the printing throughput can be improved as a whole.

Further, differently from the first embodiment, it is unnecessary to determine repeatedly whether the condition of (Tpf>Tint) is satisfied by one step while extending the CR stop position Xe by one step. That is, in relation to the CR stop position extension process, calculation of the CR stop position Xe and determination regarding whether the condition of (Tpf>Tint) is satisfied are performed once. Thus, the processing load of a CPU can be reduced as compared with the CR stop position extension process according to the first embodiment.

In addition, the present invention is not limited to the embodiments. That is, the following modifications can be made.

First Modification

The first modification is not limited to the accelerated/decelerated printing in which a printing operation starts simultaneously with the completion of a paper feeding operation, and the next paper feeding operation starts simultaneously with the completion of the printing operation. For example, it is possible to perform accelerated/decelerated printing in which the printing operation may start in the process of acceleration after the paper feeding operation is completed and a certain amount of standby time T1 lapses, or the next paper feeding operation may start in the process of deceleration after the printing operation is completed and a certain amount of standby time T2 lapses. In such a case, after it is determined whether the condition of (Tpf+T1+T2>Tcr) is satisfied, it is possible to perform an extension process in which the present stop position is extended when the condition of (Tpf+T1+T2>Tcr) is satisfied.

Second Modification

In a case in which logical seek has been performed during CR movement, if the next print data can be obtained before the present CR start, an operation including the logical seek may be performed based on the present and next print data before the present CR start. In addition, if the next paper feeding amount can be obtained before the present CR start, the CR stop position extension process (FIG. 11) may also be performed before the CR start.

Third Modification

According to the previous embodiments, the number of steps is added by one step. However, the number of steps can be added by a predetermined step of two or three steps or more. For example, even when the distance of one step is extremely short in order to perform printing with high resolution, the number of processings of a CPU or the like can be prevented from being significantly increased.

Fourth Modification

It is not essential to perform the extension process until the printing start position reaches the constant speed region. For example, the present CR stop position Xe may be extended in a range in which the printing start position can be shifted to a higher speed side in the acceleration region. In such a case, the printing throughput can be improved even if switching into constant speed printing is not performed.

Fifth Modification

When calculating Tpf and Tint, a method is used, in which the period t or T for each position step x and y is integrated with reference to the acceleration/deceleration tables for the PF and CR motor speed control. However, other methods can be employed. For example, after preparing a table in which a position shifted from the printing start position is matched with the Tpf or Tint, the Tpf and Tint corresponding to the shifted printing start position can be obtained with reference to the table without calculation whenever the printing start position is shifted.

Sixth Modification

According to the previous embodiments, the recording apparatus is embodied as the ink jet printer. However, the invention is not limited thereto. That is, the recording apparatus can be embodied as a fluid ejection apparatus for ejecting or exhausting fluid, which includes liquid, liquid phase material obtained by dispersing or mixing particles of functional material into liquid, fluid phase material such as gel, and solid which can be ejected after flowing as liquid, except for ink. For example, the recording apparatus can be embodied as a liquid phase material ejection apparatus that ejects liquid phase material including dispersed or dissolved electrode material and color material (pixel material), which are used for the manufacturing or the like of a liquid crystal display, an electroluminescence (EL) display and a surface emitting display, a liquid ejection apparatus that ejects bio-organic material used for manufacturing a bio chip, or a liquid ejection apparatus used as a precision pipette to eject liquid serving as a specimen. In addition, the recording apparatus can be embodied as a liquid ejection apparatus that ejects lubricating oil to a precision apparatus such as a watch or a camera through a pin point, a liquid ejection apparatus that ejects transparent resin solution, such as UV curing resin, onto a substrate to form a micro hemispheric lens (optical lens) or the like used for a light communication device or the like, a liquid ejection apparatus that ejects etchant such as acid or alkali to etch a substrate or the like, a fluid phase material ejection apparatus that ejects fluid phase material such as gel (e.g., physical gel), or a particulate ejection apparatus (e.g., a toner jet recording apparatus) that ejects solid such as powder (particulate) including toner or the like. Further, the invention can be applied to one of the fluid ejection apparatuses. That is, in the present disclosure, the "fluid" does not include fluid composed only of the air. For example, the "fluid" includes liquid (inorganic solvent, organic solvent, solution, liquid phase resin, liquid phase metal (metal melt) or the like), liquid phase material, fluid phase material, particulate (particle and powder) or the like. In such a case, a recording medium denotes a medium such as a substrate, onto which droplets are ejected, according to the purposes thereof. Further, the invention can be applied to one of the recording apparatuses (fluid ejection apparatuses).

What is claimed is:

1. A recording apparatus comprising:

a transport unit that transports a recording medium;

a recording unit that performs recording on the recording medium based on record data;

a moving unit that moves the recording unit in a direction intersecting a transport direction of the recording medium;

a control unit that controls the recording unit, the transport unit and the moving unit;

a stop position obtaining unit that calculates an unextended stop position of the recording unit, which reaches a present recording end position during present deceleration of the recording unit and which reaches a next recording start position during next acceleration of the recording unit, based on present record data for printing the present print line and next record data for printing a next print line;

a determining unit that calculates a standby time of the recording unit, wherein the standby time is time elapsed from when the recording unit reaches the unextended stop position to a time when the transport unit has transported the recording medium from a position on which the present print line has been completed to a start position at which movement of the recording unit starts for printing the next print line; and an extension processing unit that, when the standby time is greater than zero, defines an extended stop position to reduce the standby time, wherein, when the extension processing unit has defined the extended stop position, the control unit controls the moving unit and the recording unit such that the recording unit is stopped at the present extended stop position such that the recording unit, after having started a next movement to reach the next recording start position, reaches the next recording start position at a higher speed and starts a recording operation.

2. The recording apparatus according to claim 1, wherein the stop position obtaining unit includes:

a calculating unit that calculates a present unextended stop position of the recording unit, which reaches the present recording end position during the deceleration of the recording unit, based on the present record data; and a stop position change unit that calculates a next unextended stop position of the recording unit, which reaches the next recording start position during the acceleration of the recording unit, based on the next record data during the movement of the recording unit for the present recording, and assigns a relevant one of the present unextended stop position and the next unextended stop position as the unextended stop position calculated by the stop position obtaining unit by assigning the next unextended stop position as the unextended stop position calculated by the stop position obtaining unit when it is determined that the next unextended stop position is located at a front side in a movement direction of the recording unit, as compared with the present unextended stop position.

3. The recording apparatus according to claim 2, wherein the control unit is configured to transport the recording medium to the next recording position by driving the transport unit substantially simultaneously with completion of a recording operation of the recording unit, and to start the movement of the recording unit during execution of a transport operation of the recording medium such that next recording starts substantially simultaneously with stop of the transport operation of the recording medium, and the control unit includes:

a transport time calculating unit that calculates a medium transport time corresponding to a time required for the transport unit to transport the recording medium to the next recording position; and an interval time calculating unit that calculates a recording interval time from a time point at which a present recording operation of the recording unit is completed to a time point at which a next recording operation of the recording unit starts, wherein the determining unit determines whether the medium transport time exceeds the recording interval time, and the extension processing unit defines the extended stop position of the recording unit such that the medium transport time is not smaller than the recording interval time when the medium transport time exceeds the recording interval time.

4. The recording apparatus according to claim 3, wherein the extension processing unit extends the unextended stop position by a predetermined amount to arrive at the extended stop position, and repeats the extension process by the predetermined amount when the determining unit determines that the recording interval time based on the present extended stop position does not exceed the medium transport time.

5. The recording apparatus according to claim 4, wherein the recording unit moves with a speed profile having an acceleration region, a constant speed region and a deceleration region, and the extension processing unit performs the extension process of extending the unextended stop position by the predetermined amount, the determining unit determines whether a movement speed of the recording unit, which has reached the next recording start position, has reached the constant speed region based on the extended stop position, and the extension processing unit completes the extension process although the recording interval time does not exceed the medium transport time based on the extended stop position when it is determined that the movement speed of the recording unit has reached the constant speed region.

6. The recording apparatus according to claim 2, wherein the processing by the stop position changing unit, the determining unit and the extension processing unit is performed during present movement of the recording unit.

7. A recording method using a recording apparatus, which includes a transport unit that transports a recording medium, a recording unit that performs recording on the recording medium, a moving unit that moves the recording unit in a direction intersecting a transport direction of the recording medium by the transport unit, and a control unit that controls the recording unit, the transport unit and the moving unit, the recording method comprising:

calculating an unextended stop position of the recording unit, which reaches a present recording end position during present deceleration of the recording unit and which reaches a next recording start position during next acceleration of the recording unit, based on present record data for printing the present print line and next record data for printing a next print line;

calculating a standby time of the recording unit, wherein the standby time is time elapsed from when the recording unit reaches the unextended stop position to a time when the recording medium has been transported from a position on which the present print line has been completed to a start position at which movement of the recording unit starts for printing the next print line;

when the standby time is greater than zero, defining an extended stop position to reduce the standby time; and when the extended stop position has been defined, controlling by the control unit the moving unit and the recording unit such that the recording unit is stopped at the extended stop position such that the recording unit, after having started a next movement to reach the next recording start position, reaches the next recording start position at a higher speed and starts a recording operation.

* * * * *